United States Patent [19]

Zelle

[11] Patent Number: 4,463,627

[45] Date of Patent: Aug. 7, 1984

[54] PISTON AND CYLINDER ASSEMBLY FOR BLOCKADE ARM

[76] Inventor: C. Kenneth Zelle, 7245 Leonard St., Philadelphia, Pa. 19115

[21] Appl. No.: 231,068

[22] Filed: Feb. 3, 1981

[51] Int. Cl.[3] ..... F16H 53/06

[52] U.S. Cl. ..... 74/569

[58] Field of Search ..... 74/569; 267/64.28

[56] References Cited

U.S. PATENT DOCUMENTS

| | | |
|---|---|---|
| 2,675,657 | 4/1954 | Taggart et al. . |
| 3,421,287 | 1/1969 | Sheets . |
| 3,451,192 | 6/1967 | Irwin . |
| 3,844,092 | 10/1974 | Stringer et al. . |
| 3,935,691 | 2/1976 | Broch . |
| 3,948,015 | 4/1976 | Lerner . |

FOREIGN PATENT DOCUMENTS

| | | |
|---|---|---|
| 876873 | 9/1961 | United Kingdom . |

*Primary Examiner*—Kenneth Dorner
*Attorney, Agent, or Firm*—Seidel, Gonda & Goldhammer

[57] ABSTRACT

A pneumatic piston and cylinder assembly is preset by means of a 3-way regulating valve to exert a balancing force on a blockade arm in a retracted position. The arm is coupled via a linkage to a cam follower which rides on a rotary cam. The arm pivots in response to motion of the cam. When the cam causes the arm to pivot away from the retracted position to an advanced position, the arm overcomes the preset balancing force and causes the piston to retract gradually as air is bled to atmosphere from the cylinder via the valve. At the end of the stroke of the arm, the diminished air pressure in the cylinder provides a cushion to prevent bounce of the arm. As the cam causes the arm to reverse its stroke and pivot back to the retracted position, air is gradually admitted to the cylinder via the valve, thereby extending the piston and assisting movement of the arm. When the arm returns to the retracted position, the cylinder pressure at both ends of the stroke of the arm significantly reduces the wear of the cam and cam follower as well as the wear on the clutch interposed between the electric drive motor and the cam shaft.

14 Claims, 9 Drawing Figures

FIG. 4
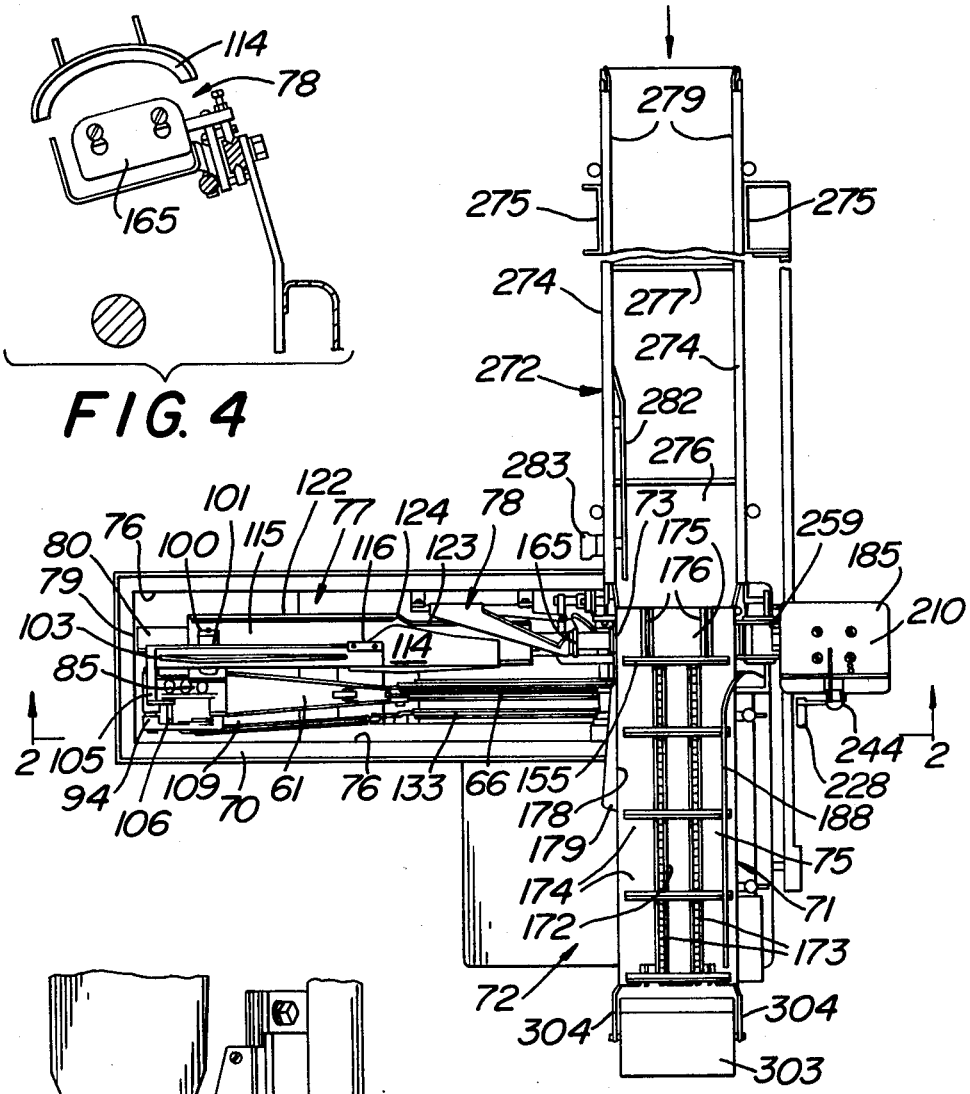
FIG. 1
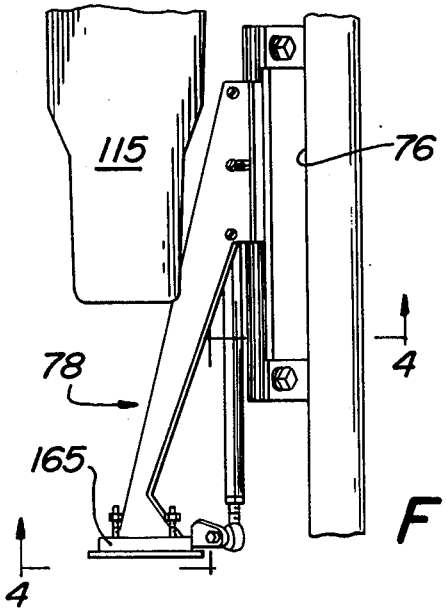
FIG. 3

PISTON AND CYLINDER ASSEMBLY FOR BLOCKADE ARM

BACKGROUND OF THE INVENTION

The invention relates to an improvement in the blockade drive mechanism for a bread packaging machine as described in U.S. Pat. No. 3,451,192 (Irwin) issued June 24, 1969. The machine described in U.S. Pat. No. 3,451,192 is used in the baking industry for packaging loaves of bread in inflatable plastic bags.

As described more fully hereafter, the blockade drive mechanism includes a reciprocable blockade arm and a clamp arm mounted for rotation on a common shaft. The clamp arm supports a cam follower which rides on the periphery of a cam. Heretofore, the blockade arm was connected to a contractile spring which biased the arm so that the cam follower was urged against the cam surface.

The use of a spring arrangement as described in U.S. Pat. No. 3,451,192 leads to several problems. When the blockade arm is in the "retracted" position, the spring exerts a maximal force on the arm, pressing the cam follower with excessive force against the cam. This produces rapid wear of the cam and cam follower as well as the clutch between the electric drive motor and the cam shaft. When the cam follower drops on the cam, the blockade arm moves to the "advanced" position and may bounce due to compression of the spring when the advanced position is reached, causing pronounced vibration of the blockade and adversely affecting operation of the blockade mechanism. When the blockade arm is returned to the "retracted" position, the arm moves against the force of the spring, again resulting in the cam follower being pressed with excessive force against the cam, contributing to wear of those parts and the clutch. In addition, the spring becomes stretched with use, requiring replacement or repair. Often, operating personnel attempt to "fix" the spring to restore it to its original tension by shortening the spring. This "fix" only aggravates the problem because the shorter spring may exert an even greater force on the blockade arm, worsening the wear problem. A shorter spring, moreover, is subject to failure during the operation of the machine.

SUMMARY OF THE INVENTION

Apparatus for exerting a balancing force on a blockade arm including a cylinder and piston assembly presetable to an adjustable pressure and pivotably coupled at one end to the blockade arm and at the other end to the machine frame. Pneumatic or hydraulic fluid is bled from and admitted to the cylinder corresponding to reciprocating pivotal movement of the blockade arm to significantly reduce wear of the cam and follower and the clutch between the drive motor and cam shaft.

BRIEF DESCRIPTION OF THE DRAWINGS

For the purpose of illustrating the invention, there is shown in the drawing a form which is presently preferred; it being understood, however, that this invention is not limited to the precise arrangements and instrumentalities shown.

FIG. 1 is a plan view of the scoop and blockade mechanisms of the conventional bagging machine shown in the retracted position.

FIG. 3 is a fragmentary sectional view taken along the lines 3—3 of FIG. 1.

FIG. 4 is a sectional view taken along the lines 4—4 of FIG. 3.

DETAILED DESCRIPTION OF THE INVENTION

Figure 2:
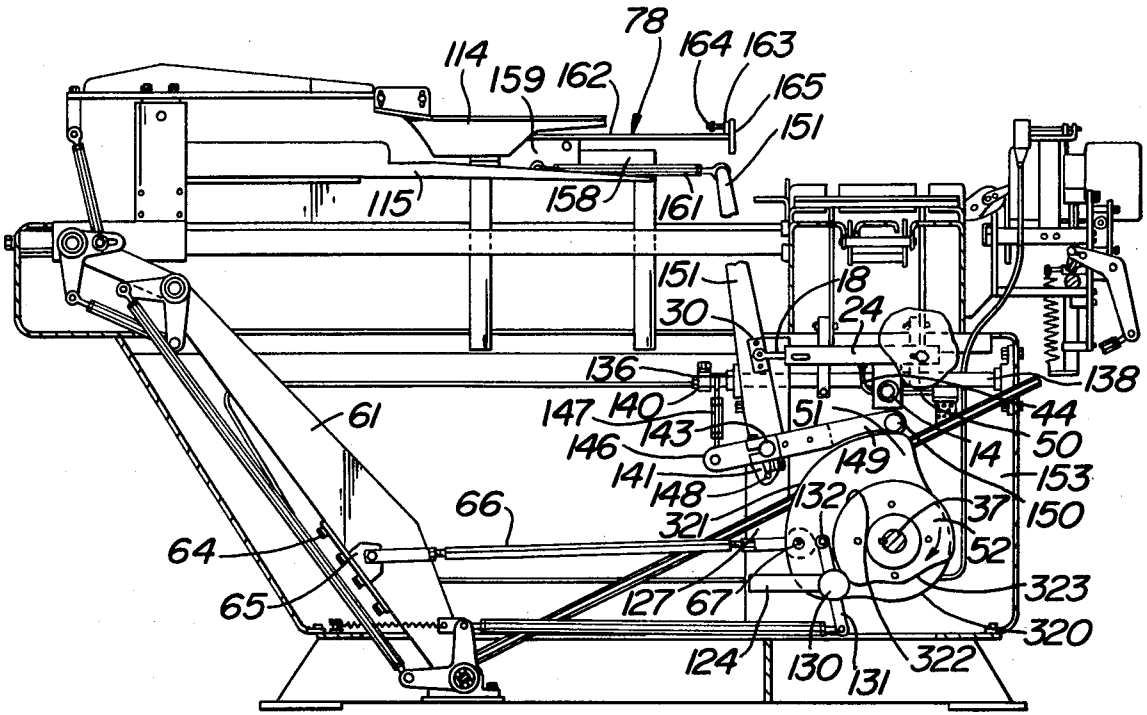
FIG. 2 is a side elevation showing the installation of the invention.

Referring to the drawings, wherein like numerals indicate like elements, there is shown in FIG. 1 the conveyor portion and scoop and blockade mechanisms of the bread packaging machine described in detail in U.S. Pat. No. 3,451,192 (Irwin) issued June 24, 1969. The numerals which identify machine parts in FIG. 1 correspond to the same numerals used to identify like parts in the patent. The description of the machine in U.S. Pat. No. 3,451,192 is incorporated herein by reference, although a brief description of operation of the machine is furnished hereinbelow to enable fuller appreciation of the background of the invention.

The scoop and blockade mechanisms are shown in the retracted position in FIG. 1. The scoop mechanism, generally designated 77, includes a shaft 79, a slide bearing 80 mounted on the shaft, a top scoop 114 and a bottom scoop 115. The bottom scoop 115 is much longer than the top scoop 114 and is mounted at its rear end on a scoop detaching bar by screws which extend through the bar and into a scoop mounting plate in turn secured to the upper face of a lug on slide bearing 80.

As shown in FIG. 2, the blockade drive mechanism includes a bearing 141 mounted on a bearing support post 127. A shaft 143 is journaled in the bearing. A clamp arm 146 is secured to shaft 143 and is pivotably connected to the lower end of an extensible link 147. The upper end of link 147 is pivotably connected to a clamp arm 140. A clamp arm 149 is also mounted on the shaft 143. The clamp arm 149 supports a cam follower roller 150 which rides on the periphery of a cam 51. A clamp arm 148 is also mounted on the shaft 143. A blockade arm 151 is bolted to the clamp arm. The blockade arm 151 is conventionally connected to the front wall 153 by a contractile spring so as to maintain the roller 150 in contact with the cam 51. The spring in not shown in FIG. 2. Rather, FIG. 2 shows the arm 151 connected to the piston and cylinder arrangement of the present invention.

The blockade mechanism 78 includes a blockade mounting plate 159 mounted on a gib 158. The plate is provided with runners which extend within grooves so as to render the plate freely slidable horizontally on the gib. An adjustable link 161 is pivotably connected to plate 159. By means of this connection, longitudinal shifting of the blockade mounting plate 159 on gib 158 is effected by the blockade arm 151 in response to motion of the cam 51.

A blockade supporting arm 162, secured by screws to plate 159, extends between the top and bottom scoops 114 and 115. A block 163, secured to the front end of arm 162, receives threaded studs 164 which are provided with coiled expansion springs held against block 163 by nuts so as to yieldably mount blockade 165 on block 163.

A deck 175 of a transverse housing section 71 is provided with two slots 172 in which conveyor chains 173 of a discharge conveyor 72 are mounted. The chains travel continuously during the operation of the bagging machine. Loaf pusher bars 174 are fixed to the chains 173.

A complete bagging cycle is performed by the bagger for each revolution of the shaft 37 on which cam 51 is mounted (FIG. 2). The rotation of shaft 37 is normally continuous. Accordingly, any particular position of the shaft 37, and corresponding position of cam 51, may be assumed as the point at which one cycle of operation ends and another begins.

Immediately upon the start button being depressed, the machine motor drives shaft 37 in the clockwise direction. Assume that, at the moment the cycle starts, the cam follower roller 150 moves upwardly from an approximately 180° low section 320 of cam 51 onto an approximately 110° high section 321. This results in the cycle starting with the blockade 165 and blockade arm 151 in the retracted position (FIG. 2). Toward the end of the first cycle of operation, the roller 150 rides down the cam section 321 onto the low section 320. The arm 151 pivots clockwise so as to advance the blockade 165 from the retracted position to the advanced position. The roller 150 remains on the low cam section 320 until just before the close of the cycle. Accordingly, the blockade 165 dwells in the advanced position for purposes described hereafter. At the conclusion of the cycle, the roller 150 rides up cam section 320 to cam section 321, and the arm 151 pivots counterclockwise so as to return the blockade 165 to the retracted position.

At the start of a bagging cycle, the scoops 114 and 115 are spaced apart by a distance intermediate a minimal (scoops closed) and maximal (scoops open) distance. The pivotal connection of pitman 66 through pin 67 with cam 51 (FIG. 2) causes arm 61 to rapidly shift slide bearing 80 and scoop mechanism 77 from the fully retracted position (leftmost) towards the fully extended position (rightmost). Between the fully retracted and extended positions, the scoopes 114 and 115 close to a minimal spacing to allow the scoops to enter an inflated bag. As the scoops enter the bag, the spacing between the scoops increases to hold the bag open and move the bag away from the bag wicket. Just before the scoops begin their return movement to the retracted position, a loaf of bread is dumped into the bottom scoop 115 and in front of the blockade 165. The scoop mechanism rapidly closes and returns to its retracted position, and the blockade 165 holds the loaf so that the bag enveloping the loaf is stripped from the retreating scoop mechanism. The blockade 165 remains in the advanced position, as previously indicated, to retain the bagged loaf in alignment with the discharge conveyor 25 until the scoop mechanism becomes entirely disassociated from the bag. The blockade is then rapidly retracted out of the mouth of the bag, and a flusher bar 155 sweeps the loaf from deck 175 into the path of pusher bar 174 of the discharge conveyor 72.

In the conventional bagging machine described, the arm 151 is connected by the contractile spring to the front wall 153 so as to maintain the roller 150 in contact with cam 51 as the arm reciprocates between the retracted and advanced positions. The spring exerts an essentially uncontrolled force on the arm 151, causing the follower 150 to be pressed with excessive force against the cam 51 during reciprocating strokes of the arm. As a result, cam follower 150 and the cam 51 experience inordinate wear and must be frequently replaced. In addition, the clutch between the electric drive motor (not shown) and cam shaft experiences excessive wear, necessitating frequent replacement.

The present invention eliminates the spring, utilizing instead a unique pneumatic or hydraulic cylinder arrangement under control of a presettable 3-way regulating valve. The preferred embodiment of the invention described hereafter is of the pneumatic type. It is understood, however, that the invention embraces both pneumatic and hydraulic systems.

Figure 5:
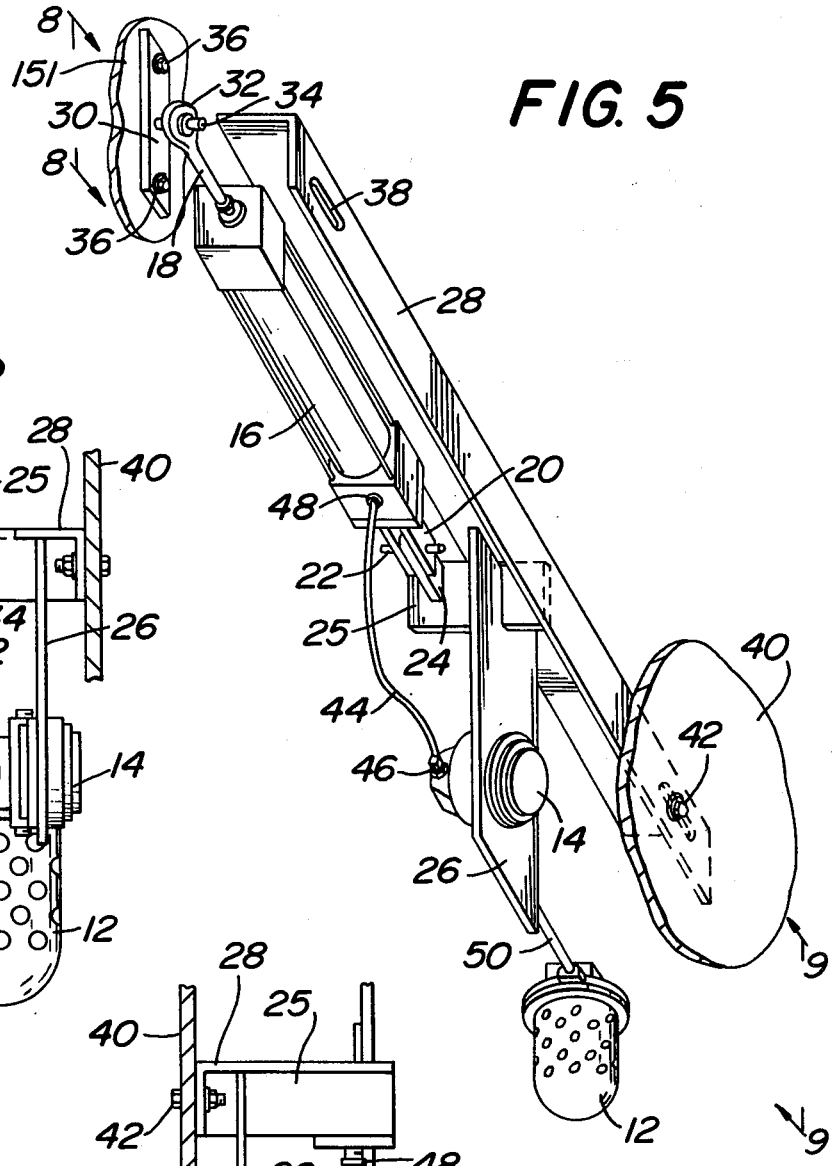
FIG. 5 is an isometric view of the invention.

Referring to FIG. 5, a filter assembly 12 is connected by a rigid conduit 50 to a 3-way regulator valve 14. Filter assembly 12 filters pressurized air which is supplied to the filter assembly by an in-plant source (not shown). The filter supplies filtered air at for example 100 psi to the valve 14. Regulator valve 14 is a 3-way valve such as a Wilkerson DialAir R 21-02-000 valve. The regulator valve is provided with a dial which is preset by the operator to reduce the pressure of the filtered air passed through flexible hose 44 to the cylinder air inlet port 48 to a level such as 25 psi at which the piston and cylinder assembly "balances" the blockade arm 151 in the retracted position. In particular, the preset level is chosen to partially offset a net clockwise moment of the arm 151 in the retracted position due to geometry and weight of the arm 151, the arm 149, and the follower 150, so that the follower 150 will rest on and follow the cam 51 with minimal pressure during operation of the blockade drive mechanism.

The piston and cylinder assembly 16 is pivotably connected to a plate 24 by means of a clevis 20 and a pin 22. The plate 24 is secured to a cross member 25 which is suitably secured to bracket 28. A depending plate 26 is secured to the cross member 25. The plate 26 supports the regulating valve 14.

Figure 8:
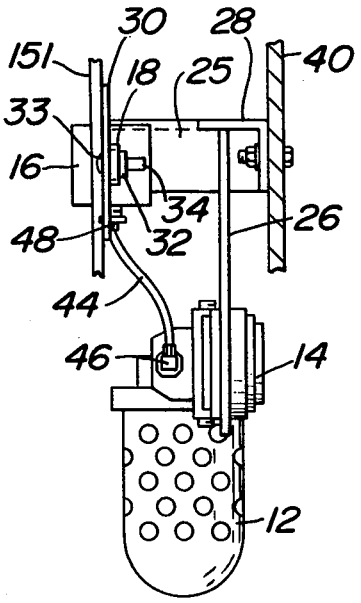
FIG. 8 is an end view taken along the lines 8—8 of FIG. 5.
Figure 9:
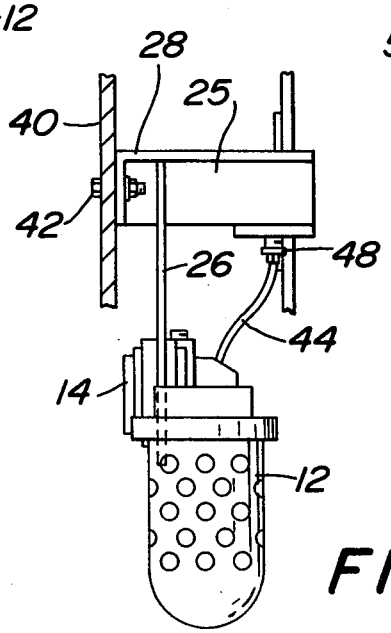
FIG. 9 is an end view taken along the lines 9—9 of FIG. 5.
Figure 6:
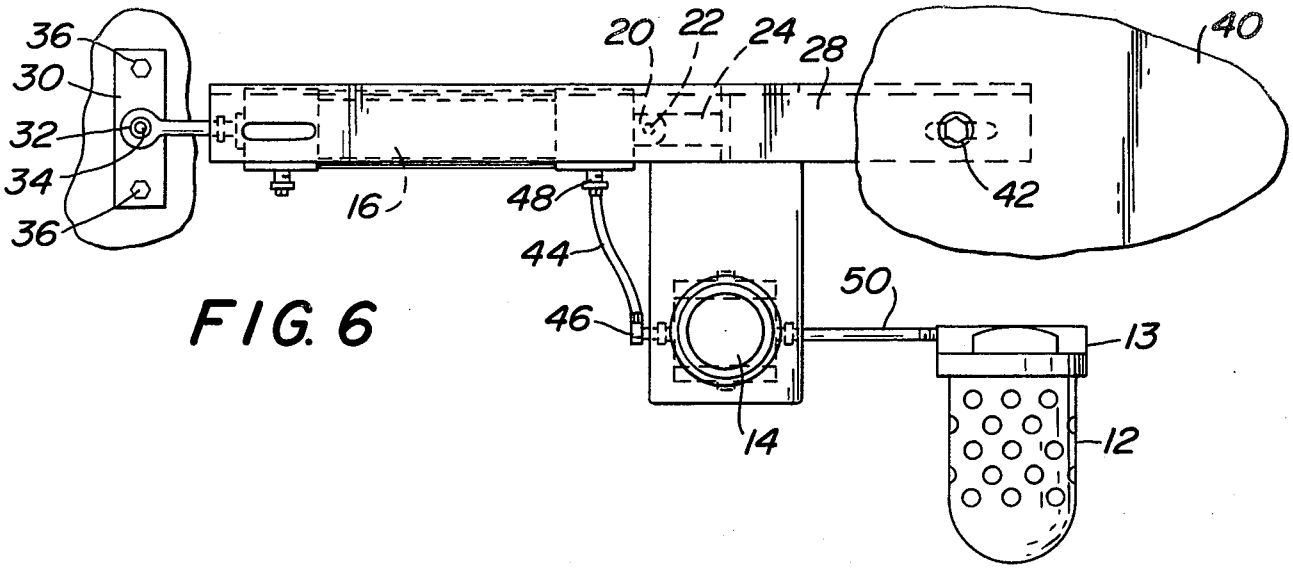
FIG. 6 is a side elevation of the invention.
Figure 7:
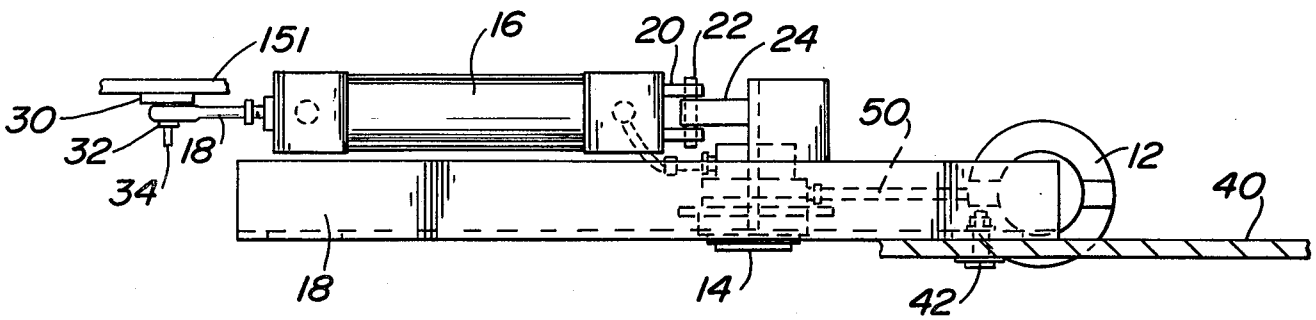
FIG. 7 is a plan view of the invention.

The cylinder assembly 16 includes a piston (not numbered) having a rod which is threadedly connected at one end to a piston rod adapter 18 such as an ALINABOL CF 7B or a HEIM HF 7 adapter. The piston rod adapter 18 is pivotably coupled to blockade arm 151. A plate 30 is bolted to the arm 151 by bolts 36. The plate 30 is provided with a pin 34 which extends through a ball bearing 33 (FIG. 8) seated in the end of the rod adapter 18. The bearing 33 permits 3-dimensional pivotal displacement of the adapter with respect to the arm 151. A collar and set screw 32 secure the bearing on the pin 34.

Bracket 28 is rigidly secured to the bagging machine frame 40 by bolts 42 which extend through slots 38 in the bracket. Accordingly, the piston and cylinder assembly 16 pivots on pin 22 as the arm 151 reciprocates between the retracted and advanced positions, and the adapter rod ball bearing connection permits slight misalignment between the planes of rotation of the arm 151 and the piston and cylinder assembly.

In operation, when the cam follower 150 is in contact with the cam surface 321, the blockade is in the fully retracted position shown in FIG. 2. The piston rod and piston rod adapter 18 are extended with respect to the cylinder assembly. Blockade operating arm 151 experiences a net moment tending to pivot the arm clockwise on shaft 143 due to the geometry and weight of the machine parts. This net moment insures that cam follower 150 rests on and presses against cam 51 with a force determined by the geometry and and weight of the parts. The piston and cylinder assembly 16 permits the operator to reduce the moment, hence the force with which the follower presses against the cam, while insuring that the follower 150 stays on the cam 51. The conventional bagging machine, using a contractile spring to bias the arm 151, is incapable of providing this control. Thus, in the conventional machine, the spring is maintained in tension when arm 151 is in the retracted position thereby increasing the force with which the follower 150 presses against cam 51. The excessive frictional engagement between the follower 150 and the cam 51 contributes to rapid wear of the follower and the cam as well as the motor clutch.

To maintain the arm 151 in the retracted position with minimal force of the follower 150 against the cam 51, regulating valve 14 is preset so that the air pressure in the cylinder is at the desired level. This level may be determined emperically by the operator and may for example be approximately 25 psi. At this desired preset level, the force exerted by the piston rod on the blockade arm 151 offsets significantly the moment of the blockade linkage when arm 151 is in the fully retracted position with the cam follower resting on high cam surface 321.

When the cam follower 150 drops down onto the low cam surface 320, the blockade linkage overcomes the preset cylinder pressure and the arm 151 rotates in the clockwise direct on shaft 143. The arm 151 displaces the piston rod, causing the piston rod to gradually retract in the cylinder. As a result, air is bled gradually from the cylinder to atmosphere via cylinder port 48, flexible hose 44, and 3-way regulating valve 14. The piston and cylinder assembly 16 therefore exerts a continuous gradually decreasing resistive force against the clockwise motion of blockade arm 151 as air is bled from the cylinder. This cushions the blockade arm 151. The piston continues to retract in the cylinder as follower 150 rides on cam surface 320 until the blockade arm 151 reaches its rightmost or advanced position. At that point, cam follower 150 begins to ride up onto cam surface 321 to begin the second or reverse half of the bagging cycle wherein the arm 151 is returned from the advanced to the retracted position. In the conventional machine, the contractile spring is in compression when the arm 151 reaches the advanced position. As a result, the spring causes the arm 151 to bounce at the advanced position with attendant vibration of the blockade. In the present invention, the residual cylinder pressure prevents bounce of the arm 151 when the arm reaches the advanced position.

As the blockade arm 151 begins to rotate counterclockwise, due to the follower 150 riding up onto cam surface 321 as described above, pressurized air is supplied automatically to the cylinder assembly 16 by regulating valve 14, thereby extending the piston. This exerts a continuous gradually increasing force on blockade arm 151 which assists in moving the arm to the retracted position. No such continuous force could be provided by the contractile spring of the conventional bagging machine since the spring undergoes a transition from compression to tension, with consequent reversal of the force exerted on arm 151, during the return stroke of the arm. Moreover, as the piston and cylinder assembly moves the blockade arm 151 to the retracted position, it gradually reduces the force with which cam follower 150 is pressed against cam 51, relieving wear between the cam follower and cam whereas the conventional spring, when going into tension, increases the force with which the follower is pressed against the cam as arm 151 returns to the retracted posi- tion.

By regulating the air pressure in the cylinder during the strokes of the operating arm 151 in this manner, that is by presetting the valve 14 and bleeding and then admitting air to restore the preset cylinder pressure to the preset level as described, the cam follower 150 is made to contact the surface of cam 51 with minimal frictional engagement which significantly reduces wear of the cam and cam follower as well as the motor clutch. Clutch life has been extended significantly in this fashion in excess of twice the life experienced using the conventional contractile spring arrangement.

The present invention may be embodied in other specific forms without department from the spirit or essential attributes thereof and, accordingly, reference should be made to the appended claims, rather than to the foregoing specification, as indicating the scope of the invention.

I claim:

1. Apparatus for regulating the motion of a reciprocable pivotable blockade linkage comprising a blockade arm and an arm provided with a cam follower, the arms being mounted on a common shaft wherein the cam follower rides on a rotary cam, comprising:

(a) fluid operated means pivotably coupled to the blockade arm for continuously resisting pivotable movement of the blockade arm from a retracted position to an advance position and for continuously assisting movement of the blockade arm from the advanced position back to the retracted position;

(b) means for regulating the flow of fluid to and from said fluid operated means to cause said fluid operated means to decreasingly resist the movement of said blockade arm from said retracted to said advanced position and to increasingly assist the movement of said blockade arm from said advanced position back to said retracted position; and (c) said means for regulating the flow of fluid to and from said fluid to operated means being presettable to cause said fluid means to balance said blockade arm in said retracted position whereby the cam follower remains on the cam in reduced frictional engagement with the cam.

2. Apparatus according to claim 1 wherein said fluid operated means comprises a piston and cylinder assembly provided with a piston which is pivotably coupled to said blockade arm and wherein said means for regulating the flow of fluid comprises a fluid valve coupled to a fluid source for venting fluid from said cylinder during movement of blockade arm from the retracted to the advanced position and for supplying fluid to the cylinder during movement of the blockade arm from the advanced position to the retracted position.

3. Apparatus according to claim 2 including a piston adapter secured to said piston and pivotably coupled to said blockade arm, said piston adapter including a ball bearing mounted on said blockade arm.

4. Apparatus for regulating the motion of a reciprocable pivotable linkage comprising a blockade arm and an arm provided with a cam follower, said arms being mounted on a common shaft, wherein the cam follower rides on a rotary cam, comprising:

(a) a piston and cylinder assembly pivotably coupled to the blockade arm;

(b) a valve coupled to a fluid source for venting fluid from said cylinder during movement of the blockade arm from a retracted to an advanced position and for supplying fluid to the cylinder during movement of the blockade arm from the advanced position back to the retracted position;

(c) said valve being presettable to cause said piston and cylinder assembly to balance the blockade arm in the retracted position such that the cam follower rests on the cam in reduced frictional contact with the cam.

5. Apparatus according to claim 4 wherein said valve is a 3-way regulating valve.

6. Apparatus according to claim 4 wherein said piston and cylinder assembly includes a piston and a piston rod adapter secured to said piston, said piston rod adapter including a ball bearing mounted on said blockade arm.

7. Apparatus for installation in a blockade drive mechanism of a bagging machine provided with a frame, wherein said blockade drive mechanism includes a reciprocable pivotable blockade arm, comprising:

(a) a bracket adapted to be mounted on the machine frame, (b) a piston and cylinder assembly including an extensible and retractable piston and cylinder pivotably mounted on said bracket, (c) means secured to the piston and adapted to couple the piston and the blockade arm in pivotable relation, (d) fluid valve means adapted to be connected to a pressurized fluid source for supplying fluid to said cylinder during extension of said piston and for venting fluid from said cylinder during retraction of said piston, (e) said fluid valve means being presettable to supply fluid at a preselected initial pressure to said cylinder.

8. Apparatus according to claim 7 wherein said means adapted to couple the piston and the blockade arm in pivotable relation includes a plate adapted to be secured to the blockade arm, said plate being provided with a pin, a rod secured to the piston, and a ball bearing seated at one end of the rod and mounted on the pin.

9. Apparatus for installation in a blockade drive mechanism of a bagging machine provided with a frame, wherein the blockade drive mechanism includes a reciprocable pivotable blockade arm, comprising:

(a) a bracket adapted to be mounted on the machine frame, (b) a piston and cylinder assembly including an extensible and retractable piston and a cylinder pivotably mounted on the bracket, (c) means adapted to be secured to the piston and to couple the piston and the blockade arm in pivotable relation, (d) a regulator valve adapted to be coupled to a pressurized fluid source for supplying fluid to the cylinder during extension of the pistion and for venting fluid from the cylinder during retraction of the piston, (e) said regulator valve being presettable to supply fluid at an initial preselected pressure to the cylinder.

10. Apparatus according to claim 9 wherein said means adapted to couple the piston and the blockade arm in pivotable relation includes a plate adapted to be secured to the blockade arm, said plate being provided with a pin, a rod adapted to be secured to the piston, and a ball bearing seated in the rod and adapted to be mounted on the pin.

11. In a bagging machine including a blockade drive mechanism comprising a reciprocable pivotable blockade arm, the improvement comprising:

(a) fluid operated means pivotably coupled to the blockade arm for continuously resisting pivotable movement of the blockade arm from a retracted position to an advanced position and for continuously assisting movement of the blockade arm from the advanced position back to the retracted position, (b) means for regulating flow of fluid to and from said fluid operated means to cause said fluid operated means to continuously decreasingly resist the movement of said blockade arm from said retracted to said advanced position and to continuously increasingly assist the movement of said blockade arm from said advanced position back to said retracted position, (c) said means for regulating the flow of fluid being presettable to cause said fluid operated means to balance said blockade arm in said retracted position.

12. Apparatus according to claim 11 wherein said means for regulating fluid flow comprises a fluid valve for continuously venting fluid from said fluid operated means during movement of the blockade arm from the retracted to the advanced position and for continuously supplying fluid to the fluid means during movement of the blockade arm from the advanced position back to the retracted position.

13. Apparatus according to claim 11 wherein said fluid operated means comprises a piston and cylinder assembly including an extensible and retractable piston and a cylinder, said cylinder being mounted for pivotable movement about an axis spaced from the blockade arm, and means for pivotably coupling the piston to the blockade arm.

14. Apparatus according to claim 13 wherein said means for pivotably coupling said piston to said blockade arm includes a rod secured to said piston, a ball bearing seated in said rod, and means for mounting the ball bearing on the blockade arm.

* * * * *